US007662028B2

(12) United States Patent
Feng et al.

(10) Patent No.: US 7,662,028 B2
(45) Date of Patent: Feb. 16, 2010

(54) POLISHING PAD HAVING GROOVE STRUCTURE FOR AVOIDING STRIPPING OF A POLISHING SURFACE OF THE POLISHING PAD

(75) Inventors: Chung-Chih Feng, Kaohsiung (TW); Wei-Te Liu, Kaohsiung (TW); Yung-Chang Hung, Kaohsiung (TW); Chun-Ta Wang, Kaohsiung (TW); I-Peng Yao, Kaohsiung (TW)

(73) Assignee: Bestac Advanced Material Co., Ltd., Taoyuan County (TW)

( * ) Notice: Subject to any disclaimer, the term of this patent is extended or adjusted under 35 U.S.C. 154(b) by 0 days.

(21) Appl. No.: 12/139,525

(22) Filed: Jun. 16, 2008

(65) Prior Publication Data

US 2009/0258587 A1 Oct. 15, 2009

(30) Foreign Application Priority Data

Apr. 11, 2008 (TW) ..... 97113293 A

(51) Int. Cl.
*B24D 11/00* (2006.01)

(52) U.S. Cl. ..... 451/526; 451/527; 451/533

(58) Field of Classification Search ..... 451/41, 451/59, 63, 287, 526, 527, 528, 529, 530, 451/533

See application file for complete search history.

(56) References Cited

U.S. PATENT DOCUMENTS 6,241,596 B1 * 6/2001 Osterheld et al. ..... 451/527
7,234,224 B1 * 6/2007 Naugler et al. ..... 29/557
7,329,174 B2 * 2/2008 Hosaka et al. ..... 451/527
7,357,703 B2 * 4/2008 Nishimura et al. ..... 451/527
2002/0137450 A1 * 9/2002 Osterheld et al. ..... 451/527
2006/0286350 A1 * 12/2006 Hendron et al. ..... 428/156
2007/0032182 A1 * 2/2007 Suzuki ..... 451/527
2007/0066195 A1 * 3/2007 Duong ..... 451/526
2007/0077862 A1 * 4/2007 Swedek et al. ..... 451/5
2007/0082587 A1 * 4/2007 Hosaka et al. ..... 451/56
2007/0149096 A1 * 6/2007 Nishimura et al. ..... 451/41
2008/0064311 A1 * 3/2008 Suzuki ..... 451/527
2008/0220702 A1 * 9/2008 Feng et al. ..... 451/527

* cited by examiner

*Primary Examiner*—Eileen P. Morgan
(74) *Attorney, Agent, or Firm*—Volentine & Whitt, P.L.L.C.

(57) ABSTRACT

A groove structure for avoiding stripping of a polishing surface of a polishing pad, the polishing pad including a base material and a grinding layer. The base material has a surface. The grinding layer is disposed on the surface, and part of the surface around the edge of the base material is exposed. The grinding layer has a plurality of first grooves and second grooves, and the first grooves cross the second grooves to define a plurality of grinding areas. The exposed part of the surface around the edge of the base material is located between the first grooves, the second grooves and the edge of the polishing pad. The polishing pad contains more grinding liquid, to clean the small grinded pieces. The grinding layer does not have an acute structure and is not easily peeled to form the small grinded pieces. Therefore, grinding quality and grinding effect are improved.

9 Claims, 3 Drawing Sheets

POLISHING PAD HAVING GROOVE STRUCTURE FOR AVOIDING STRIPPING OF A POLISHING SURFACE OF THE POLISHING PAD

BACKGROUND OF THE INVENTION

1. Field of the Invention

The present invention relates to a polishing pad, in particularly, to a polishing pad having a groove structure for avoiding the polishing surface stripping.

2. Description of the Related Art

FIG. 1 shows a conventional polishing pad having grooves extending in direction XY. The conventional polishing pad 1 has a plurality of grooves 11 which are perpendicular to one another. Other conventional polishing pads may adopt a design of grooves in different shapes, mostly extending in direction XY or other variations thereof, and the pattern of the grooves is fabricated according to certain specifications.

In regard to the cutting size of the conventional polishing pad 1 and the pattern of the grooves 11, due to the geometric design, smaller grinding areas 12 may be formed at the outmost edge of the conventional polishing pad 1. The smaller grinding areas 12 generally have an acute structure, which is liable to scratch the polishing article. Further, in the course of a grinding process, the conventional polishing pad 1 suffers a downward pressing force to closely abut against the polishing article. At the same time, the conventional polishing pad 1 moves in a horizontal direction, so as to grind the polishing article to-and-fro. However, since the grinding areas 12 at the outermost portion of the conventional polishing pad 1 are smaller and have the acute structure, the grinding areas 12 suffer the greatest centrifugal force during the grinding process. When moving in the horizontal direction, the conventional polishing pad 1 in frictional contact with the polishing article suffers a greater shear stress, and is thus liable to peel off from the base material and become small grinded pieces, which impairs the grinding quality and the grinding effect.

Consequently, there is an existing need for providing a polishing pad having a groove structure for avoiding the polishing surface stripping to solve the above-mentioned problems.

SUMMARY OF THE INVENTION

The present invention is directed to a polishing pad having a groove structure for avoiding the polishing surface stripping, which comprises a base material and a grinding layer. The base material has a surface. The grinding layer is disposed on the surface and part of the surface around the edge of the base material is exposed. The grinding layer has a plurality of first grooves and second grooves, wherein the first grooves cross the second grooves to define a plurality of grinding areas. The exposed part of the surface around the edge of the base material is located between the first grooves, the second grooves and the edge of the polishing pad.

Since the outmost edge of the polishing pad does not have smaller grinding areas, the grinding layer of the polishing pad will not peel off from the base material to become small grinded pieces during the grinding process. In addition, the grinding layer also does not have acute structure and will not scratch the polishing article, thus providing a better grinding quality and grinding effect. Furthermore, more grinding liquid can be contained between the exposed part of the surface around the edge of the base material, the first grooves, the second grooves and the edge of the polishing pad, which is contributive to clean the small grinded pieces. Therefore, the grinding effect can be improved.

DETAILED DESCRIPTION OF THE INVENTION

Figure 1:
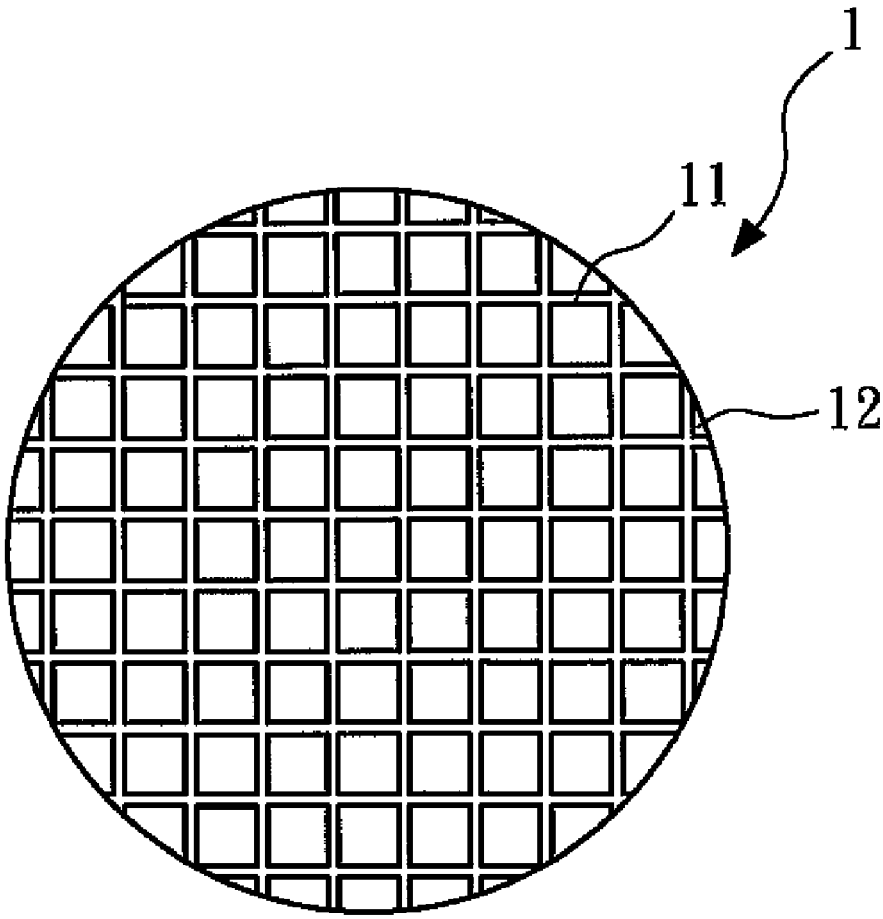
FIG. 1 (Prior Art)
FIG. 1 shows a conventional polishing pad having grooves extending in direction XY.
Figure 2A:
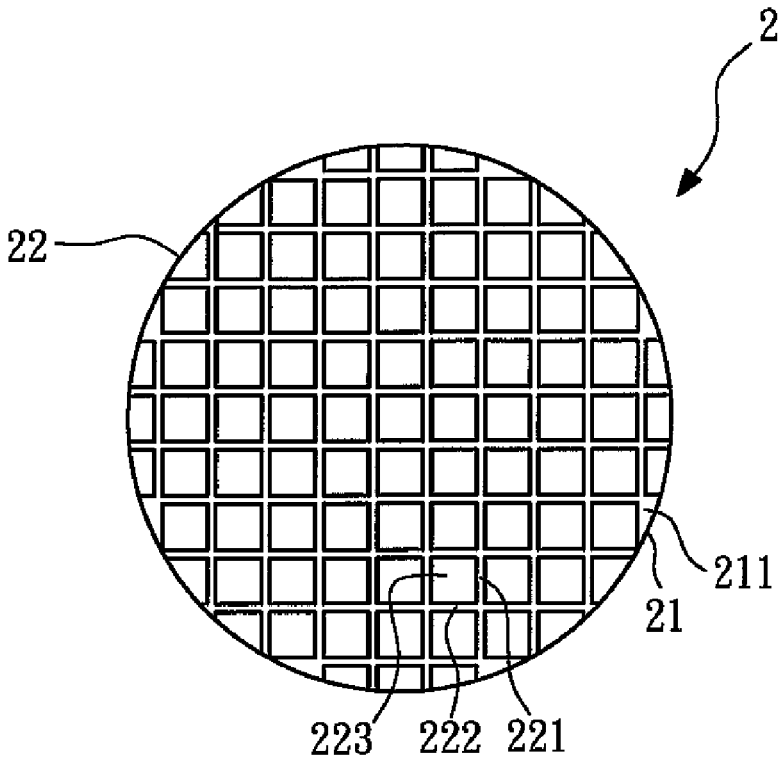
FIG. 2A is a schematic view of a polishing pad having a groove structure for avoiding the polishing surface stripping according to a first embodiment of the present invention.
Figure 2B:
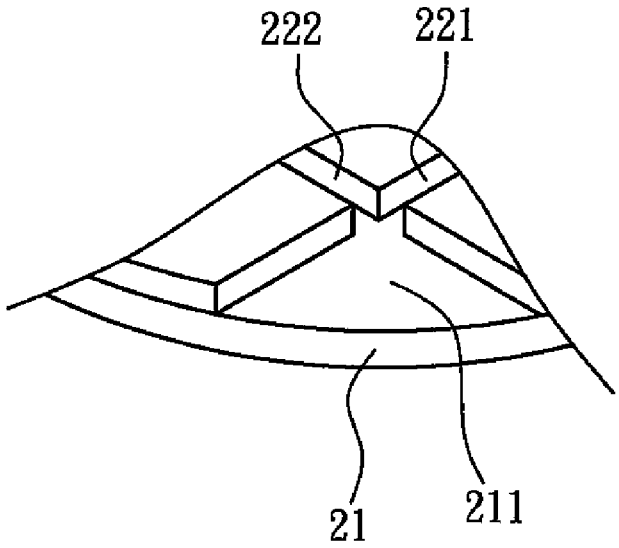
FIG. 2B is a schematic partial perspective view of the polishing pad having a groove structure for avoiding the polishing surface stripping according to the first embodiment of the present invention.

FIG. 2A is a schematic view of a polishing pad having a groove structure for avoiding the polishing surface stripping according to a first embodiment of the present invention. FIG. 2B is a schematic partial perspective view of the polishing pad having a groove structure for avoiding the polishing surface stripping according to the first embodiment of the present invention. Referring to FIGS. 2A and 2B, the polishing pad 2 comprises a base material 21 and a grinding layer 22. The base material 21 has a surface 211. The grinding layer 22 is disposed on the surface 211 and exposes part of the surface 211 around the edge of the base material 21. The grinding layer 22 has a plurality of first grooves 221 and a plurality of second grooves 222, and the first grooves 221 cross the second grooves 222 to define a plurality of grinding areas 223. The exposed part of the surface 211 around the edge of the base material 21 is located between the first grooves 221, the second grooves 222 and the edge of the polishing pad 2.

In this embodiment, the first grooves 221 are perpendicular to the second grooves 222. Each of the first grooves 221 has a first groove width, the grinding areas 223 between the first grooves 221 have a first distance, and a ratio of the first distance to the first groove width is 1 to 50. Each of the second grooves 222 has a second groove width, the grinding areas 223 between the second grooves 222 has a second distance, and a ratio of the second distance to the second groove width is 1 to 50. In addition, each of the first grooves 221 further has a first groove depth, and a ratio of the first groove width to the first groove depth is 0.5 to 1.5. Each of the second grooves 222 further has a second groove depth, and a ratio of the second groove width to the second groove depth is 0.5 to 1.5.

Figure 3:
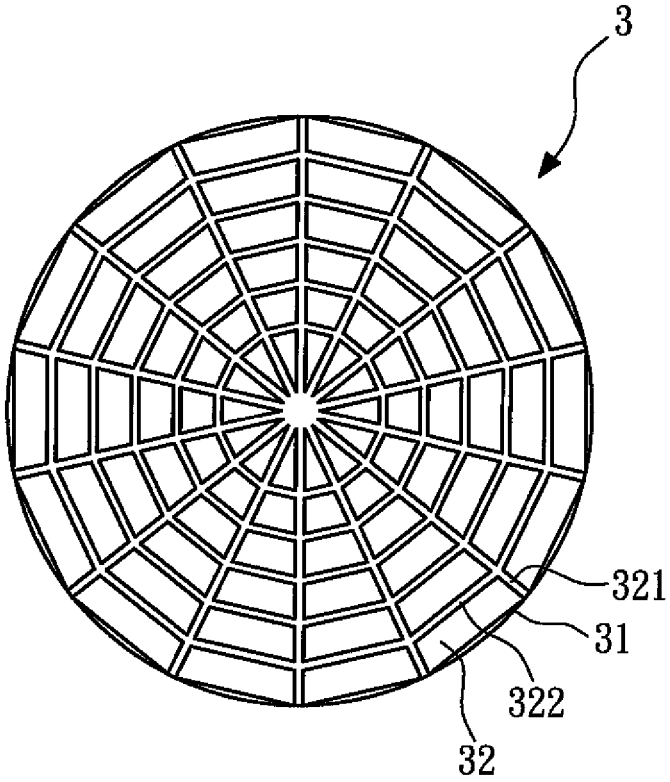
FIG. 3 is a schematic view of a polishing pad having a groove structure for avoiding the polishing surface stripping according to a second embodiment of the present invention.

FIG. 3 shows a polishing pad having a groove structure for avoiding the polishing surface stripping according to a second embodiment of the present invention is shown. Referring to FIG. 3, the polishing pad 3 comprises a base material 31 and a grinding layer 32. The difference of the second embodiment from the polishing pad 2 of the first embodiment in FIG. 2 is described as follows. In the second embodiment, the first grooves 321 of the polishing pad 3 extend from a center point of the polishing pad 3 to an edge of the polishing pad 3, and the second grooves 322 of the polishing pad 3 connect the adjacent first grooves 321.

Figure 4:
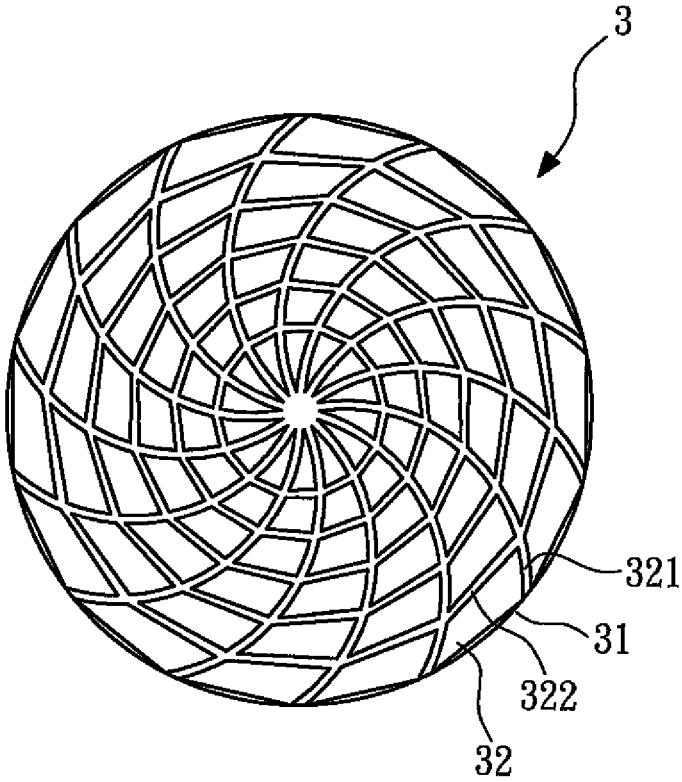
FIG. 4 is a schematic view illustrating another type of the polishing pad having a groove structure for avoiding the polishing surface stripping according to the second embodiment of the present invention.

In the second embodiment, the first grooves 321 and the second grooves 322 are linear grooves. It should be noted that the first grooves 321 may also be arc-shaped grooves, and the second grooves 322 are linear grooves (as shown in FIG. 4). But, the first grooves 321 and the second grooves 322 are not limited to the above-mentioned shapes.

Since the outmost edge of the polishing pad does not have smaller grinding areas, although the polishing pad is in frictional contact with the polishing article, wherein the polishing pad suffers a downward pressing force to closely abut against the polishing article and the polishing pad moves in a horizontal direction to grind the polishing article to-and-fro at the same time, and although the polishing pad suffers the greater shear stress during the grinding process, the grinding layer of the polishing pad will not peel off from the base material to become small grinded pieces. In addition, the grinding layer also does not have acute structure and is not easy to scratch the polishing article, thus providing a better grinding quality and grinding effect. Furthermore, more grinding liquid can be contained between the exposed part of the surface around the edge of the base material, the first grooves, the second grooves and the edge of the polishing pad, which is contributive to clean the small grinded pieces. Therefore, the grinding effect can be improved.

While the embodiments of the present invention have been illustrated and described, various modifications and improvements can be made by those skilled in the art. The embodiments of the present invention are therefore described in an illustrative but not restrictive sense. It is intended that the present invention may not be limited to the particular forms as illustrated, and that all modifications that maintain the spirit and scope of the present invention are within the scope as defined in the appended claims.

What is claimed is:

1. A polishing pad having a groove structure for avoiding stripping of a polishing surface of the polishing pad, comprising:

a base material, having a surface; and a grinding layer, disposed on a part of the surface and exposing a part of the surface around an edge of the base material, wherein the grinding layer has a plurality of first grooves and a plurality of second grooves, the first grooves cross the second grooves to define a plurality of grinding areas, and the exposed part of the surface around the edge of the base material includes areas of the first grooves and the second grooves around the edge of the base material and areas that are not covered by the grinding areas located between the first grooves around the edge of the base material, the second grooves around the edge of the base material, and the edge of the base material, wherein some of the exposed areas occur at the edge of the pad where the first grooves and second grooves do not intersect at the edge of the pad.

2. The polishing pad as claimed in claim 1, wherein the first grooves are perpendicular to the second grooves.

3. The polishing pad as claimed in claim 2, wherein each of the first grooves has a first groove width, and the grinding areas between the first grooves have a first distance, and a ratio of the first distance to the first groove width is 1 to 50; each of the second grooves has a second groove width, and the grinding areas between the second grooves have a second distance, and a ratio of the second distance to the second groove width is 1 to 50.

4. The polishing pad as claimed in claim 3, wherein each of the first grooves further has a first groove depth, and a ratio of the first groove width to the first groove depth is 0.5 to 1.5; each of the second grooves further has a second groove depth, and a ratio of the second groove width to the second groove depth is 0.5 to 1.5.

5. The polishing pad as claimed in claim 1, wherein the first grooves extend from a center point of the polishing pad to the edge of the polishing pad, and the second grooves connect adjacent ones of the first grooves.

6. The polishing pad as claimed in claim 5, wherein the first grooves are linear grooves.

7. The polishing pad as claimed in claim 5, wherein the first grooves are arc-shaped grooves.

8. The polishing pad as claimed in claim 5, wherein each of the first grooves has a first groove width and a first groove depth, and a ratio of the first groove width to the first groove depth is 0.5 to 1.5; each of the second grooves has a second groove width and has a second distance therebetween, and a ratio of the second distance to the second groove width is 1 to 50.

9. The polishing pad as claimed in claim 8, wherein each of the second grooves further has a second groove depth, and a ratio of the second groove width to the second groove depth is 0.5 to 1.5.

* * * * *